US005149224A

United States Patent [19]

Smith

[11] Patent Number: 5,149,224

[45] Date of Patent: Sep. 22, 1992

[54] INTERLOCKING HIGHWAY STRUCTURE

[76] Inventor: Rodney I. Smith, Rte. 2, Box 7, Midland, Va. 22728

[21] Appl. No.: 384,788

[22] Filed: Jul. 25, 1989

[51] Int. Cl.[5] ..... E01F 13/00

[52] U.S. Cl. ..... 404/6; 404/9; 256/13.1

[58] Field of Search ..... 404/1, 9, 13, 6; 256/1, 256/13.1; 285/325; 52/583, 588

[56] References Cited

U.S. PATENT DOCUMENTS

| | | | |
|---|---|---|---|
| 3,276,333 | 10/1966 | Blok | 256/13.1 X |
| 4,113,400 | 9/1978 | Smith | 404/6 |
| 4,661,010 | 4/1987 | Almér et al. | 404/6 |
| 4,666,332 | 5/1987 | Burgett | 404/6 |
| 4,849,652 | 7/1989 | Schroughan | 404/6 |

*Primary Examiner*—William P. Neuder

*Attorney, Agent, or Firm*—Gipple & Hale

[57] ABSTRACT

A interlocking highway barrier structure and system are described in which rigid upright barrier sections are disposed end to end in interlocking relationship with one another. Each of the sections of the system can have a grooved end to accommodate and engage with a similar adjacent end of the section next to it. The ends of each section of the system are provided with interlock plates for connecting together the adjacent sections. Each interlock plate is attached to its respective section and has an extending vertical edge which is bent into a "U" shaped cross-section to engage a similar edge or lip on the interlock plate of the adjacent section such that lateral movement of the respective plates and sections is prevented. The respective sections of the system can, however, be easily implaced or removed by vertically displacing the sections.

6 Claims, 6 Drawing Sheets

INTERLOCKING HIGHWAY STRUCTURE

SUMMARY OF THE INVENTION

The present invention is directed to a highway crash barrier system comprising a plurality of rigid sections disposed end to end in interlocking relationship with one another. The end of each section has a groove and is provided with imbedded interlocks which respectively join with one another to hold the sections in alignment. The interlocking structure of the sections permits individual sections to be removed or replaced without disrupting the remainder of the crash barrier system while maintaining proper alignment of the system.

BACKGROUND OF THE INVENTION

Various barrier systems have been employed along road ways and are important in blocking off areas from traffic, delineating driving lanes and otherwise providing means for controlling the flow of traffic along highways. In recent years it has also become the common practice to employ barrier systems that are constructed of large sections of concrete block that can be hoisted into place and subsequently removed with greater speed and ease than is usually required to construct more permanent structures. Frequently, such systems have consisted of large precast concrete blocks which are simply distributed along a roadway. Systems of this type, while relatively easy to install and disassemble, can, however, be dislodged if sufficient force is applied, thereby resulting in a potential traffic hazard. In some instances, the sections of concrete block are bolted together to maintain the alignment of the sections and assure that they will not be either knocked over or displaced by any external force such as a colliding vehicle. These systems have, however, had the disadvantage that the means of attaching one block to another can be complex and expensive and require considerable time and effort to assemble, particularly when a large number of blocks are required to extend over a long stretch of roadway. Such systems also have required extensive effort when it is desired to remove or move some or all of these blocks, as frequently becomes the case when road repairs are being made a section at a time along a highway. Further, in systems where the blocks are joined by bolts or other means which are subsequently covered by the assembled units, it may be difficult or virtually impossible to remove a single section without disassembling the entire structure.

Accordingly, it is an object of the present invention to provide an inexpensive highway crash barrier system consisting of a plurality of rigid sections which are joined in alignment together but which can individually be easily and quickly removed without the necessity of extensive time consuming disengagement operations. It is a further object of the present invention to provide a system of interlocking sections for a highway crash barrier system in which the respective sections engage one another in a simple but mechanically sound manner to facilitate alignment and stability of the entire system without encumbering it with expensive and mechanically complex coupling devices. Yet, a further object of the present invention is to provide a system of interlocking sections for a road barrier system which is relatively simple and inexpensive to construct and erect along the highway.

DETAILED DESCRIPTION OF THE INVENTION

In accordance with the present invention, a highway barrier system is provided which comprises a plurality of rigid upright sections disposed end to end in interlocking relationship such that the end of each of the interlocking sections engages and interlocks with the end of the adjacent upright section. In one embodiment, the engaging ends of the respective sections of the barrier system are configured in a "tongue and groove" manner so that each such end has a projecting portion and a recessed cavity to accommodate the projecting portion on the section adjacent it. Each recessed cavity of the end of a section is provided with a vertically aligned, interlocking plate which can be partially embedded into the section or otherwise attached. The non-embedded vertical edge of the interlock plate is bent back to form a U-shaped lip which is disposed in the recessed cavity of the section and which engages and interlocks with a similar lip on the vertically aligned interlock plate of the adjacent section.

In another embodiment of the invention, the interlocking plate actually extends beyond the recessed cavity of the section in which it is embedded, so that the lips of adjacent interlock plates are actually engaged when adjacent barrier sections are slightly separated.

The vertical alignment and engagement of the interlock plates prevents lateral movement of the respective sections of the highway barrier system but permits the sections to be positioned by vertical displacement, i.e., raising or lowering.

The invention will, however, be more fully understood and appreciated by having specific reference to the drawings which illustrate a preferred embodiment thereof.

Figure 1:
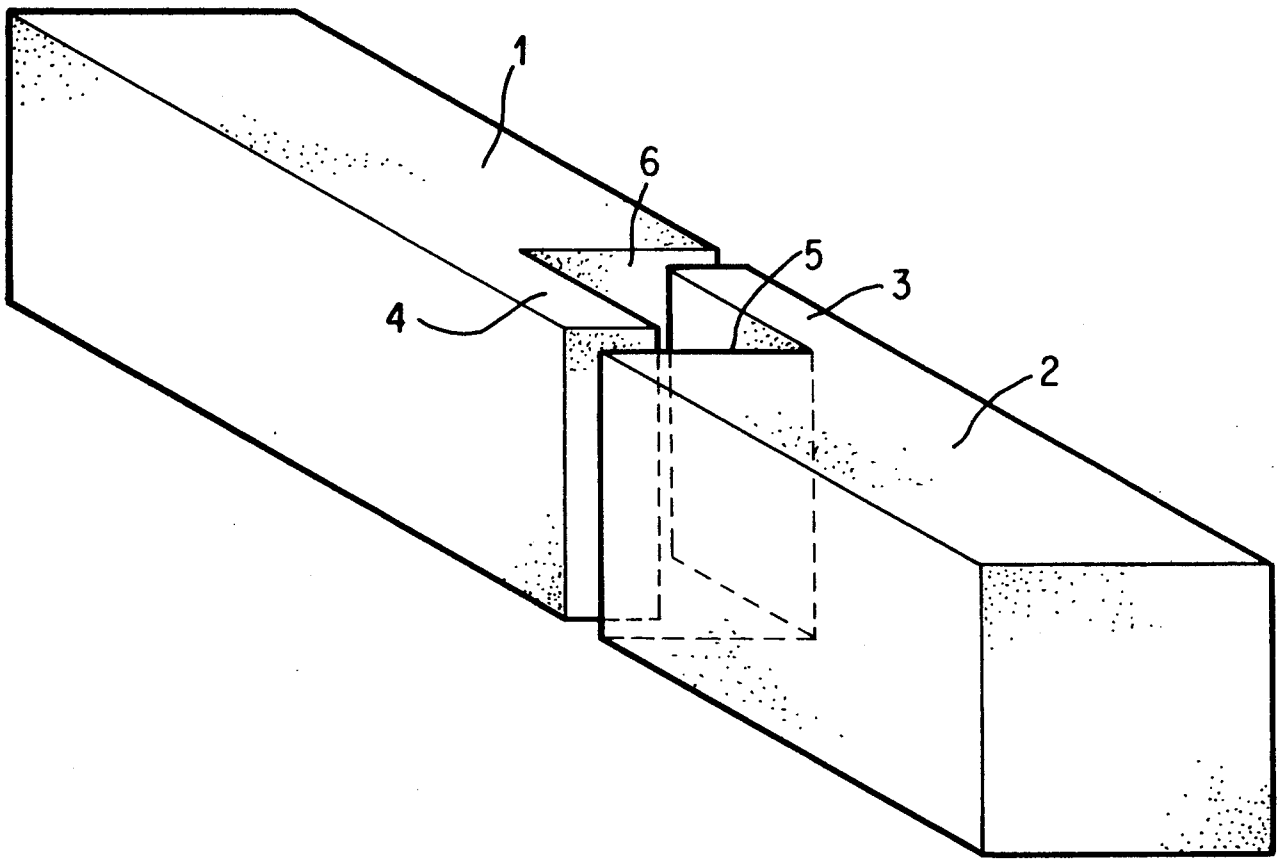
FIG. 1 is a perspective view of two interlocking sections of the barrier system of the present invention.

Directing attention to FIG. 1 of the drawings, two rigid upright sections 1 and 2 of a highway barrier system of the invention are shown. The opposing ends of the two sections are respectively notched to provide projections 3 and 4 and recessed cavities 5 and 6 so that the two sections when aligned with one another interlock to form a portion of the highway barrier system. The interlock plates attached to each section, which prohibit lateral movement of the sections and provide positive engagement are not visible in FIG. 1.

Figure 2:
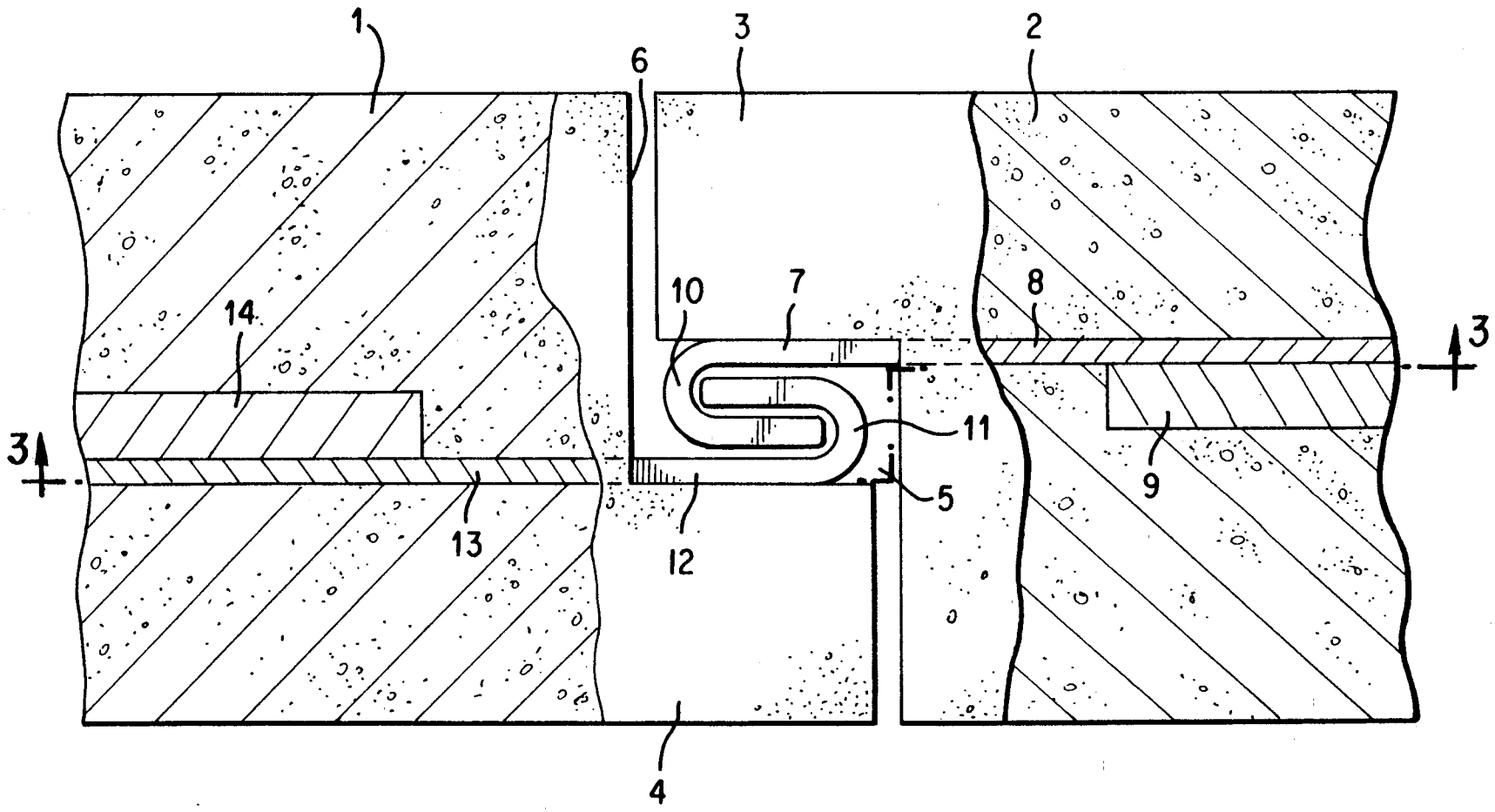
FIG. 2 is a top plan view of the interface of two barrier sections illustrating the interlock.

FIG. 2 of the drawings illustrates in greater detail the actual interlock system whereby the respective sections of the highway barrier system are maintained in positive, interlocking alignment with one another. As illustrated, two upright sections of the barrier system 1 and 2 are disposed in the same alignment as illustrated in FIG. 1 such that extending portion 3 of section 2 extends into the recessed cavity 6 of section 1 and extending portion 4 of section 1 extends into the recessed cavity 5 of section 2. The alignment of the respective sections 1 and 2 is moreover, maintained against lateral displacement by the respective interlock plates 7 and 12 which are attached to the respective barrier sections. A portion of interlock plates 7 and 8 is shown actually embedded into barrier section 2. To further reinforce the attachment of the interlock plate with the barrier section, metal bars 9 and 14 can be respectively attached to the embedded portions 8 and 13 of the respective interlock plates 7 and 12. The non-embedded ends 10 and 11 of the two interlock plates 7 and 12 respectively are bent to form U-shaped lips having edges parallel to one another and to the interlock plates 7 and 12. As can be seen in FIG. 2, which is a top plan view of the interface of two sections of the highway barrier system of the invention, each section can be lowered vertically into place so that the lips of the respective interlock plates at either end of a section engage one another as shown to prevent lateral displacement of the sections of the system when they are aligned. If desired, a section of the system can be removed with out disturbing the adjacent sections by raising the section vertically to disengage the interlocking plates.

Figure 3:
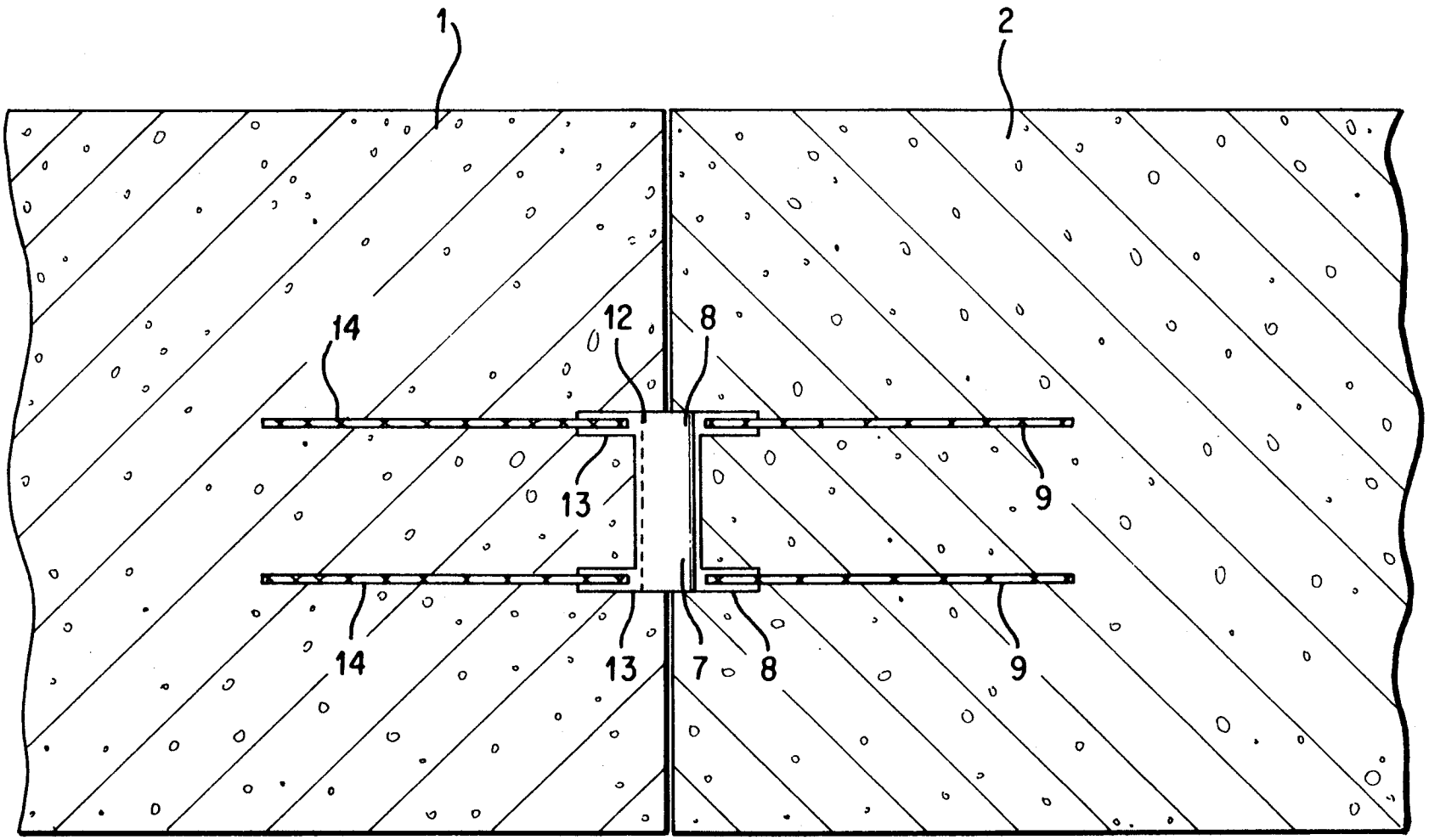
FIG. 3 is a side cutaway view of the interface of two barrier sections.

FIG. 3 of the drawings is side cutaway view illustrating the engaged interlock plates embedded within the respective barrier sections 1 and 2. As seen, each interlock plate 7 and 12 has a pair of projections 8 and 13 which extend into the barrier section and which are attached to imbedded rods 9 and 14, respectively.

Figure 4:
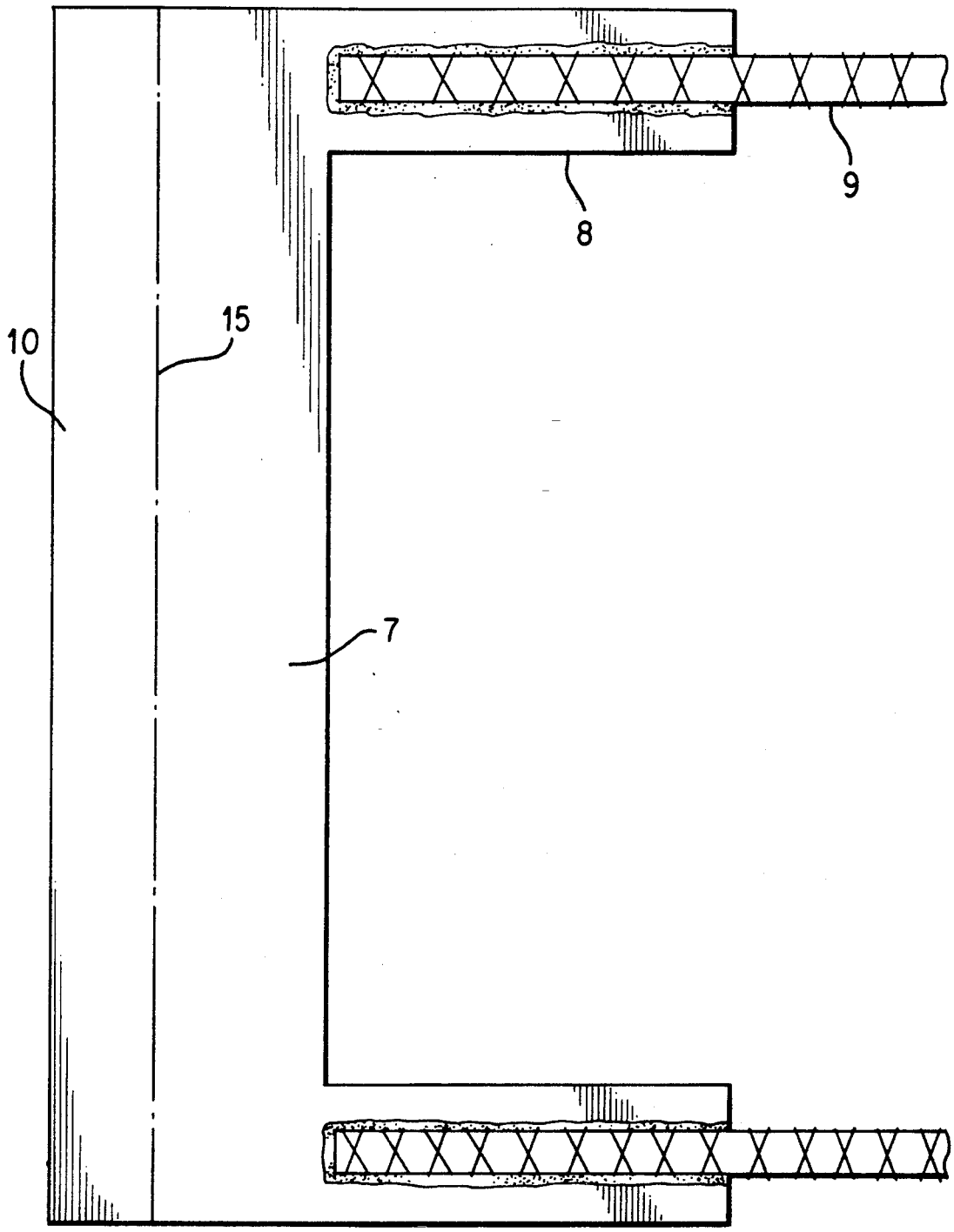
FIG. 4 is a side view of one of the interlock plates of the invention.

FIG. 4 of the drawings is a detailed illustration of one interlock plate 7 having metal bars 9 attached to interlock plate projections 8. The plate 7 is folded back at 15 so that portion 10 forms a U-shaped lip parallel to the plate 7.

Figure 5:
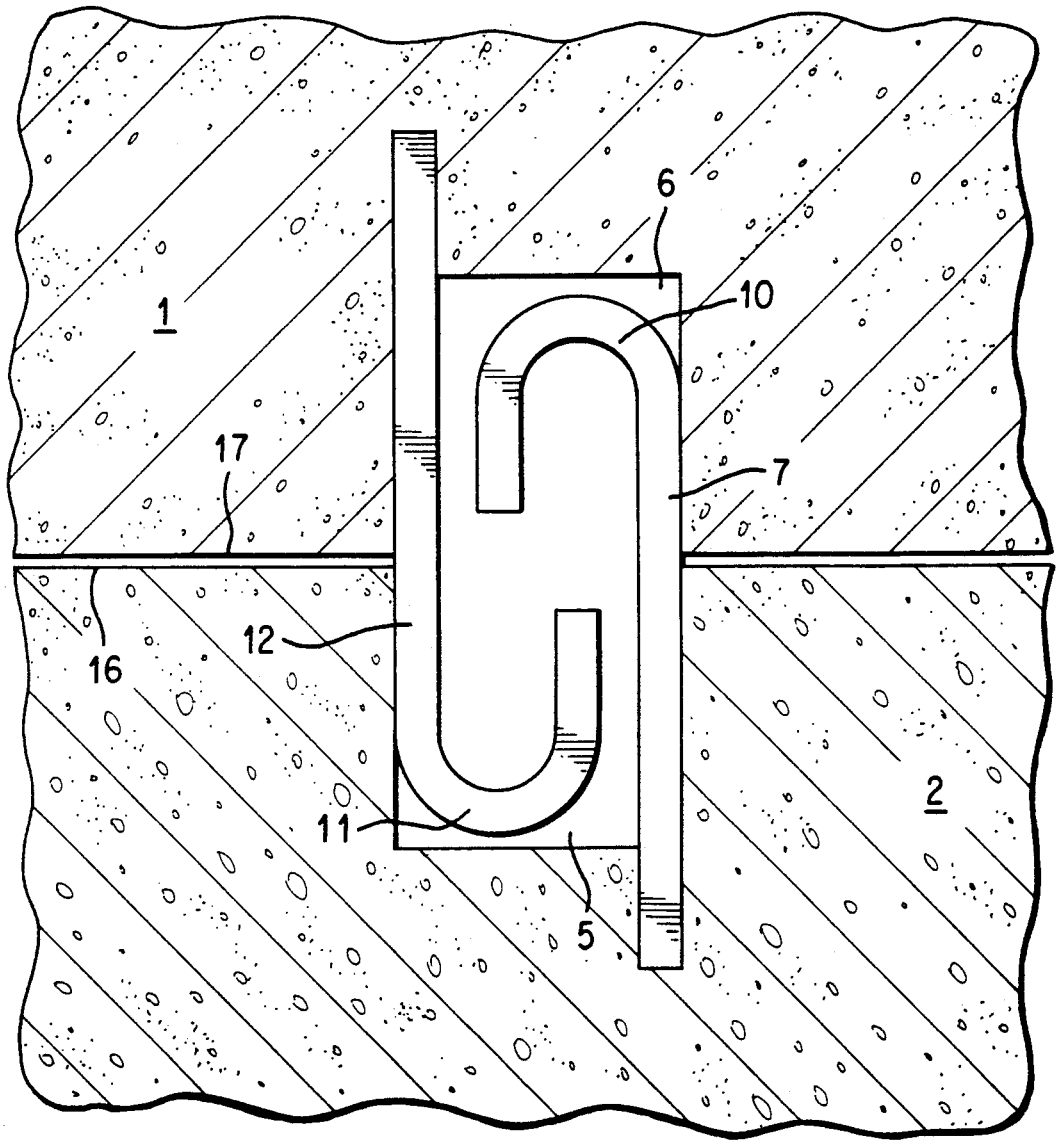
FIG. 5 is a top plan view of an alternative embodiment of the invention.
Figure 6:
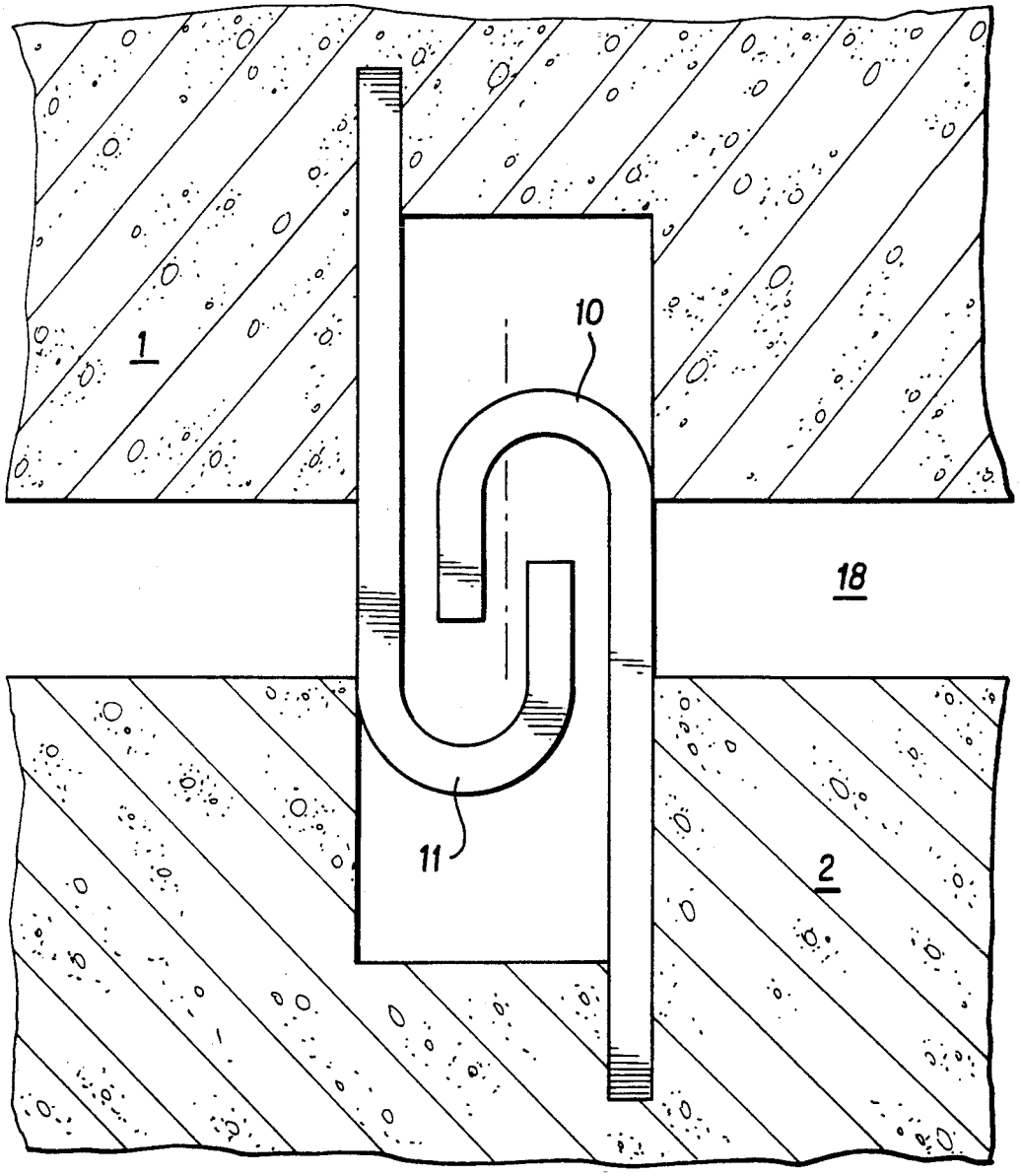
FIG. 6 illustrates the engagement of the embodiment of FIG. 5.

As shown in FIGS. 5 and 6 of the drawings, in another embodiment of the invention, recessed cavities 5 and 6 are provided in the ends of barrier sections 2 and 6 respectively, however the abutting faces of the ends of the two sections are otherwise flush and no projecting portion is provided as in the previously described embodiment. Instead the two mutually interlocking plates 7 and 12 extend beyond the respective flush abutting faces 16 and 17 into the cavities 6 and 5. As seen in FIG. 5, the "U" shaped ends of the plates 7 and 12 will not normally engage one another in positive interlocking relationship when the abutting faces 16 and 17 are proximate to one another. Positive interlocking of the plates is achieved as shown in FIG. 6 by moving the adjacent sections somewhat apart to present a gap between the sections. This embodiment of the invention has the advantage of facilitating implacement of the sections of the barrier and allowing a greater degree of deviation from linear alignment of the barrier sections since the interlocking plates function to a limited extent like a hinge to permit some lateral movement of one section relative to the adjacent section.

In addition to providing an inexpensive and relatively easily fabricated means for maintaining sections of highway barrier systems in engagement together, the present invention provides a positive interlock which prevents lateral displacement of the respective sections of the highway barrier system such as would be caused by a vehicle making contact with the barrier. The present invention, however, permits sections of the barrier system to easily be removed by simply vertically lifting them out of place since the interlock system of the invention provides no impediment to such vertical displacement.

It will further be appreciated that while a preferred embodiment of the present invention has been described herein for illustrative purposes, other embodiments can of course be carried out within the scope and spirit of the present invention. For example, other modes of attachment of the interlock plates to the respective barrier sections can be employed as well as various materials both for the sections themselves and the interlock plates.

What is claimed:

1. A highway barrier system comprising a plurality of rigid upright sections disposed end to end in interlocking relationship, the end of each said sections having a projecting portion and a recessed cavity disposed at its ends such that the recessed cavity of one section accommodates the adjacent projecting portion of the interlocking section next to it, each of said recessed cavities being further provided with interlock means partially attached thereto for connecting together adjoining sections, each of said interlock means projecting into its own recessed cavity and being adapted to engage the projecting part of the interlock means of the section next to it to hold said sections together and in alignment.

2. The highway barrier system of claim 1 wherein said interlock means each comprise a vertically aligned interlock plate having one vertical edge imbedded in said upright section and the other vertical edge extending into the recessed cavity of the section and formed into a lip of a "U" shaped cross-section adapted to engage a similar lip on the interlock means of the adjacent section.

3. A highway barrier structure for use in a highway barrier system comprising a plurality of said structures disposed in linear, interlocking relationship, said structure comprising a rigid, upright sections having a projecting portion and a recessed cavity disposed at each of its ends to accommodate similar recessed and projecting portions on adjacent, engaged sections in the highway barrier system, said recessed cavity of said structure being provided with interlock means attached thereto for connecting together said adjacent, engaged sections, said interlock means projecting into said recessed cavity and being adapted to engage a similar interlock means on an adjacent engaged section to hold said section in alignment.

4. The highway barrier structure of claim 3 wherein said interlock means each comprise a vertically aligned interlock plate having one vertical edge imbedded in said upright section and the other vertical edge extending into the recessed cavity of the section and formed into a lip of a "U" shaped cross-section adapted to engage a similar lip on the interlock means of the adjacent section.

5. A highway barrier system comprising a plurality of rigid upright sections disposed end to end in interlocking relationship, the end of each upright section being provided with a recessed cavity from which projects an interlock means attached to said section to engage a similar interlock means projecting out of the recessed cavity in the adjacent end of the next upright section, said respective interlock means holding adjacent sections in alignment when the opposing ends of said sections are proximate to one another.

6. The highway barrier system of claim 5 wherein said interlock means each comprise a vertically aligned interlock plate having one vertical edge imbedded in said upright section and the other vertical edge extending beyond the recessed cavity and end of said section, said extending vertical edge being formed into a lip of "U" shaped cross-section adapted to engage a similar lip on the interlock means of the adjacent section.

* * * * *